US009829832B2

(12) United States Patent
Yonesaka et al.

(10) Patent No.: US 9,829,832 B2
(45) Date of Patent: Nov. 28, 2017

(54) IMAGE FORMING APPARATUS DETERMINING APPROPRIATE VALUE OF SECONDARY TRANSFER VOLTAGE ACCORDING TO FIRST COLOR AND PLURAL COLOR TEST IMAGES TRANSFERRED TO A MEDIUM

(71) Applicant: FUJI XEROX CO., LTD., Tokyo (JP)

(72) Inventors: Ryosuke Yonesaka, Kanagawa (JP); Shinya Takaishi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/060,923

(22) Filed: Mar. 4, 2016

(65) Prior Publication Data

US 2017/0082955 A1 Mar. 23, 2017

(30) Foreign Application Priority Data

Sep. 17, 2015 (JP) ..... 2015-184059

(51) Int. Cl.
*G03G 15/00* (2006.01)
*G03G 15/16* (2006.01)

(52) U.S. Cl.
CPC ..... *G03G 15/1605* (2013.01); *G03G 15/1675* (2013.01); *G03G 15/5062* (2013.01); *G03G 15/55* (2013.01)

(58) Field of Classification Search
CPC ..... G03G 15/1665; G03G 15/1675; G03G 15/5058
See application file for complete search history.

(56) References Cited

U.S. PATENT DOCUMENTS 9,152,095 B1 * 10/2015 Zaretsky ..... G03G 15/1675
2003/0091357 A1 * 5/2003 Maebashi ..... G03G 15/01 399/49
2004/0253012 A1 * 12/2004 Ishibashi ..... G03G 15/50 399/49
2005/0260003 A1 * 11/2005 Tezuka ..... G03G 15/5062 399/15

(Continued)

FOREIGN PATENT DOCUMENTS

JP 07-131651 A 5/1995
JP 2002062713 A * 2/2002
JP 2006-259142 A 9/2006

*Primary Examiner* — Walter L Lindsay, Jr.
*Assistant Examiner* — Arlene Heredia Ocasio
(74) *Attorney, Agent, or Firm* — Sughrue Mion, PLLC

(57) ABSTRACT

An image forming apparatus includes two or more photoconductors, an image carrier, first and second transfer units, first and second measuring units, and a determining unit. The first measuring unit measures density of a first test image formed by using a toner of a first color and transferred from the image carrier to a medium. The second measuring unit measures density of a toner on a topmost layer of a second test image formed by superposing plural toners of different colors and transferred from the image carrier to the medium. The determining unit determines whether an appropriate value of the second transfer voltage has increased or decreased over time from a currently applied second transfer voltage, in accordance with a change in the density measured by the first measuring unit during a certain period and a change in the density measured by the second measuring unit during the certain period.

12 Claims, 15 Drawing Sheets

(56) References Cited

U.S. PATENT DOCUMENTS

| | | | | |
|---|---|---|---|---|
| 2011/0292417 | A1* | 12/2011 | Miyagi | H04N 1/6033 358/1.9 |
| 2013/0286442 | A1* | 10/2013 | Nishida | G03G 15/0189 358/3.27 |
| 2015/0037054 | A1* | 2/2015 | Nagata | G03G 15/5058 399/49 |

* cited by examiner

FIG. 11

| SECOND DENSITY | FIRST SLOPE | SECOND SLOPE | DETERMINATION RESULT |
|---|---|---|---|
| GREATER THAN FIRST THRESHOLD AND SECOND THRESHOLD | 0 OR GREATER | 0 OR GREATER | UNDEFINED |
| | 0 OR GREATER | SMALLER THAN 0 | |
| | SMALLER THAN 0 | 0 OR GREATER | |
| | SMALLER THAN 0 | SMALLER THAN 0 | |
| SMALLER THAN FIRST THRESHOLD | 0 OR GREATER | 0 OR GREATER | UNDEFINED |
| | 0 OR GREATER | SMALLER THAN 0 | INCREASED |
| | SMALLER THAN 0 | 0 OR GREATER | UNDEFINED |
| | SMALLER THAN 0 | SMALLER THAN 0 | |
| SMALLER THAN SECOND THRESHOLD | 0 OR GREATER | 0 OR GREATER | UNDEFINED |
| | 0 OR GREATER | SMALLER THAN 0 | |
| | SMALLER THAN 0 | 0 OR GREATER | |
| | SMALLER THAN 0 | SMALLER THAN 0 | DECREASED |

A TRANSFER FAILURE MAY OCCUR IN THE IMAGE FORMING APPARATUS SINCE THE DIFFERENCE BETWEEN THE CURRENT SECOND TRANSFER VOLTAGE AND ITS APPROPRIATE VALUE IS INCREASING. PLEASE CONTACT THE OPERATOR AND MAKE A REQUEST TO ADJUST THE SECOND TRANSFER VOLTAGE.

FIG. 19A

| FIRST CONDITION | |
|---|---|
| SECOND DENSITY | SMALLER THAN FIRST THRESHOLD |
| FIRST SLOPE | 0 OR GREATER |
| SECOND SLOPE | SMALLER THAN 0 |

FIG. 19B

| SECOND CONDITION | |
|---|---|
| SECOND DENSITY | SMALLER THAN SECOND THRESHOLD |
| FIRST SLOPE | SMALLER THAN 0 |
| SECOND SLOPE | SMALLER THAN 0 |

IMAGE FORMING APPARATUS DETERMINING APPROPRIATE VALUE OF SECONDARY TRANSFER VOLTAGE ACCORDING TO FIRST COLOR AND PLURAL COLOR TEST IMAGES TRANSFERRED TO A MEDIUM

CROSS-REFERENCE TO RELATED APPLICATIONS

This application is based on and claims priority under 35 USC 119 from Japanese Patent Application No. 2015-184059 filed Sep. 17, 2015.

BACKGROUND

Technical Field

The present invention relates to an image forming apparatus and method and a non-transitory computer readable medium.

SUMMARY

According to an aspect of the invention, there is provided an image forming apparatus including two or more photoconductors, an image carrier, first and second transfer units, first and second measuring units, and a determining unit. The two or more photoconductors each hold an image formed by using a toner. The image carrier holds images transferred from the two or more photoconductors. The first transfer unit transfers images from the two or more photoconductors to the image carrier by applying a first transfer voltage to the two or more photoconductors and the image carrier. The second transfer unit transfers an image from the image carrier to a medium by applying a second transfer voltage to the image carrier and the medium. In the second transfer unit, if the second transfer voltage changes, the efficiency of transferring a toner which forms an image to be transferred from the image carrier to the medium starts to decrease from a point of a peak. The peak is determined by the number of times that the first transfer voltage is applied to the image. The first measuring unit measures density of a first test image which has been formed by using a toner of a first color and which has been transferred from the image carrier to the medium. The second measuring unit measures density of a toner on a topmost layer of a second test image which has been formed by superposing plural toners of different colors and which has been transferred from the image carrier to the medium. The determining unit determines whether an appropriate value of the second transfer voltage has increased or decreased over time from the second transfer voltage which is currently applied, in accordance with a change in the density measured by the first measuring unit during a certain period and a change in the density measured by the second measuring unit during the certain period.

BRIEF DESCRIPTION OF THE DRAWINGS

An exemplary embodiment of the present invention will be described in detail based on the following figures, wherein:

FIG. 11 illustrates the relationships between determination results and the slopes of regression lines of the first density and the second density;

FIGS. 19A and 19B respectively illustrate a first condition and a second condition used in a modified example.

DETAILED DESCRIPTION

[1] Exemplary Embodiment

Figure 1:
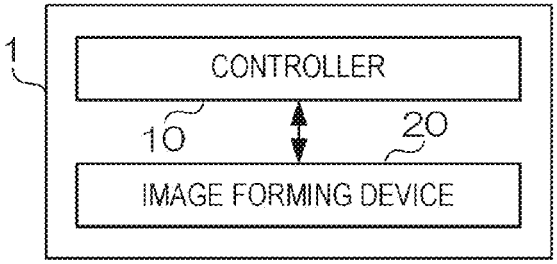
FIG. 1 illustrates the overall configuration of an image forming apparatus according to an exemplary embodiment.

FIG. 1 illustrates the overall configuration of an image forming apparatus 1 according to an exemplary embodiment. The image forming apparatus 1 forms a color image on a medium by using an electrophotographic system. The image forming apparatus 1 includes a controller 10 and an image forming device 20. The controller 10 is connected to an external device via a communication line (not shown), and upon receiving image data from the external device, the controller 10 performs processing for converting the color format of the image data, for example, from a red (R), green (G), and blue (B) format into a cyan (C), magenta (M), yellow (Y), and black (K) format. The controller 10 then outputs the processed image data to the image forming device 20.

The image forming device 20 forms an image indicated by the image data processed by the controller 10 on a medium. The image forming device 20 forms a color image by fixing four toners, that is, YMCK toners, on a medium.

Figure 2:
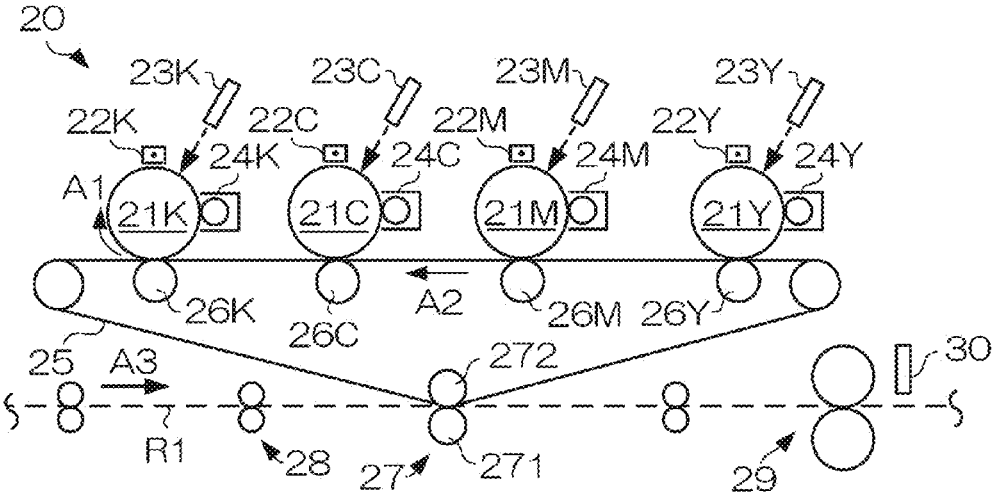
FIG. 2 illustrates an example of the hardware configuration of an image forming device.

FIG. 2 illustrates an example of the hardware configuration of the image forming device 20. The image forming device 20 includes photoconductor drums 21, chargers 22, exposure units 23, developing units 24, first transfer units 26, an intermediate transfer belt 25, a second transfer unit 27, a transport unit 28, a fixing unit 29, and a sensor 30.

The plural photoconductor drums 21, chargers 22, exposure units 23, developing units 24, and first transfer units 26 are disposed along the intermediate transfer belt 25 in accordance with the YMCK colors. In FIG. 2, alphabets Y, M, C, and K are appended to reference numerals of these elements, and reference numerals with these alphabets designate corresponding elements which perform image formation concerning the corresponding colors. Unless it is necessary to distinguish the individual colors of an element from each other (for example, photoconductor drums 21Y, 21M, 21C, and 21Y), such an element will simply be designated by reference numeral without the alphabets (for example, photoconductor drum 21 or photoconductor drums 21).

The photoconductor drums 21 are provided according to the color and each hold an image thereon formed by using a toner of a corresponding color. The photoconductor drum 21 is an example of a photoconductor according to an exemplary embodiment of the invention. The photoconductor drum 21 has a photosensitive layer. The photoconductor drum 21 holds a latent image (also called an electrostatic latent image) and an image formed by developing a latent image with toner on the surface of the photosensitive layer while rotating in the direction indicated by the arrow A1 in FIG. 2.

The charger 22 charges the photosensitive layer of the photoconductor drum 21 so that the surface of the photosensitive layer will be at a predetermined potential. The exposure unit 23 irradiates the charged photosensitive layer with exposure light so that the photosensitive layer will be exposed to light. The intensity of the exposure light and the position at which the photosensitive layer is irradiated with the exposure light are controlled in accordance with the image data. With this exposure operation, a latent image representing an image indicated by the image data is formed on the photosensitive layer.

The developing unit 24 has a developing roller which sucks and transports charged toner. The developing unit 24 applies a developing bias voltage to the photoconductor drum 21 and the developing roller, and supplies toner from the developing roller to the photoconductor drum 21, thereby developing the latent image. In this manner, by using toner, the developing unit 24 forms a visualized image on the photoconductor drum 21 at a position at which the latent image is formed.

The intermediate transfer belt 25 is an endless belt and holds images transferred from the photoconductor drums 21 (first transfer). The intermediate transfer belt 25 is an example of an image carrier according to an exemplary embodiment of the invention. The intermediate transfer belt 25 is rotatably supported by plural support rollers, and rotates in the direction indicated by the arrow A2 in FIG. 2 upon receiving a driving force. Y, M, C, and K toner images are respectively transferred from the photoconductor drums 21Y, 21M, 21C, and 21K to the intermediate transfer belt 25 in this order.

The first transfer unit 26 applies a first transfer voltage to the photoconductor drum 21 and the intermediate transfer belt 25 so as to transfer the image held on the photoconductor drum 21 to the intermediate transfer belt 25 (first transfer). The first transfer voltage is a potential difference between the surface of the photoconductor drum 21 and the surface of the intermediate transfer belt 25. The first transfer unit 26 has a first transfer roller at a position at which the first transfer unit 26 opposes the photoconductor drum 21 with the intermediate transfer belt 25 therebetween. The first transfer unit 26 applies a bias voltage to the first transfer roller and the photoconductor drum 21 so as to generate a potential difference represented by the first transfer voltage between the surface of the photoconductor drum 21 and the surface of the intermediate transfer belt 25. Because of this potential difference, the image held on the surface of the photoconductor drum 21 is transferred to the surface of the intermediate transfer belt 25 (first transfer).

The second transfer unit 27 applies a second transfer voltage to a portion between the intermediate transfer belt 25 and a medium so as to transfer the image held on the surface of the intermediate transfer belt 25 to the medium (second transfer). The second transfer voltage is a potential difference between the surface of the intermediate transfer belt 25 and the surface of the medium. The second transfer unit 27 has a second transfer roller 271 and a backup roller 272. The second transfer roller 271 and the backup roller 272 oppose each other with the intermediate transfer belt 25 therebetween and form a nip part.

The transport unit 28 has plural rollers, and transports the medium in the transport direction indicated by the arrow A3 in FIG. 2 along a transport path R1 which passes through the nip part. The medium transported by the transport unit 28 contacts the intermediate transfer belt 25 at the nip part. The second transfer unit 27 applies a bias voltage to a portion between the second transfer roller 271 and the backup roller 272 so as to generate a potential difference represented by the second transfer voltage between the surface of the intermediate transfer belt 25 and the surface of the medium. Because of this potential difference, the image held on the surface of the intermediate transfer belt 25 is transferred to the surface of the medium (second transfer).

The fixing unit 29 fixes the image transferred to the medium onto the medium. In this exemplary embodiment, the sensor 30 is disposed on the downstream side of the fixing unit 29 in the transport direction A3, and measures the physical quantity (for example, the amount of light generated as a result of diffuse reflection) indicating the density of toner of the image fixed on the medium by the fixing unit 29.

Figure 3:
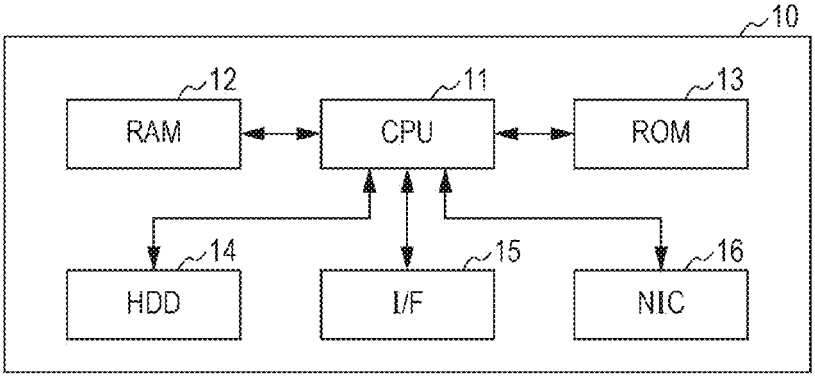
FIG. 3 illustrates an example of the hardware configuration of a controller.

FIG. 3 illustrates an example of the hardware configuration of the controller 10. The controller 10 is a computer including a central processing unit (CPU) 11, a random access memory (RAM) 12, a read only memory (ROM) 13, a hard disk drive (HDD) 14, an interface (I/F) 15, and a network interface card (NIC) 16. The CPU 11 executes programs stored in the ROM 13 and the HDD 14 by using the RAM 12 as a work area so as to control the individual elements. The HDD 14 stores therein data and programs used by the CPU 11 to control the individual elements. The I/F 15 is an interface through which the controller 10 sends and receives, for example, image data, to and from the image forming device 20. The NIC 16 includes a communication circuit and communicates with an external device via a communication line (not shown).

Figure 4:
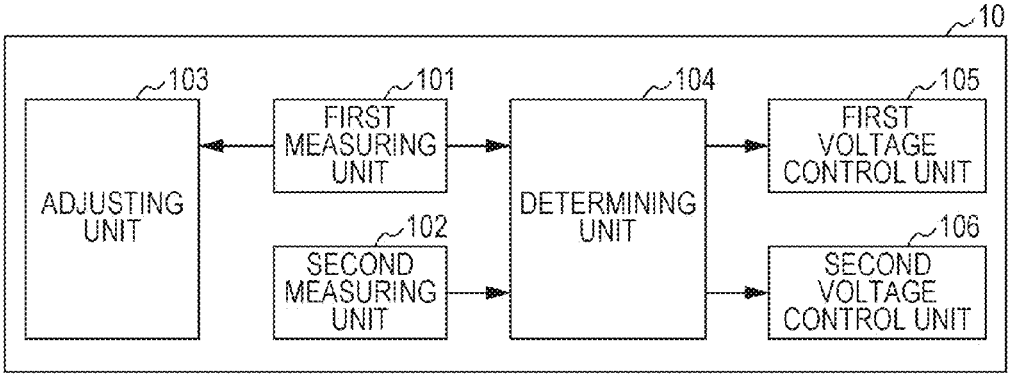
FIG. 4 is a block diagram illustrating the functional configuration of the controller.

As a result of the CPU 11 of the controller 10 executing a program, the functions shown in FIG. 4 are implemented.

FIG. 4 is a block diagram illustrating the functional configuration of the controller 10. The controller 10 includes a first measuring unit 101, a second measuring unit 102, an adjusting unit 103, a determining unit 104, a first voltage control unit 105, and a second voltage control unit 106.

The first measuring unit 101 measures the density of a test image formed by using at least one of Y, M, C, and K toners and transferred to a medium by the second transfer unit 27. In the image forming apparatus 1, a test image group including plural test images is formed on a medium and is used for adjustments to be made by the adjusting unit 103 and determinations to be made by the determining unit 104, which will be discussed later.

Figure 5:
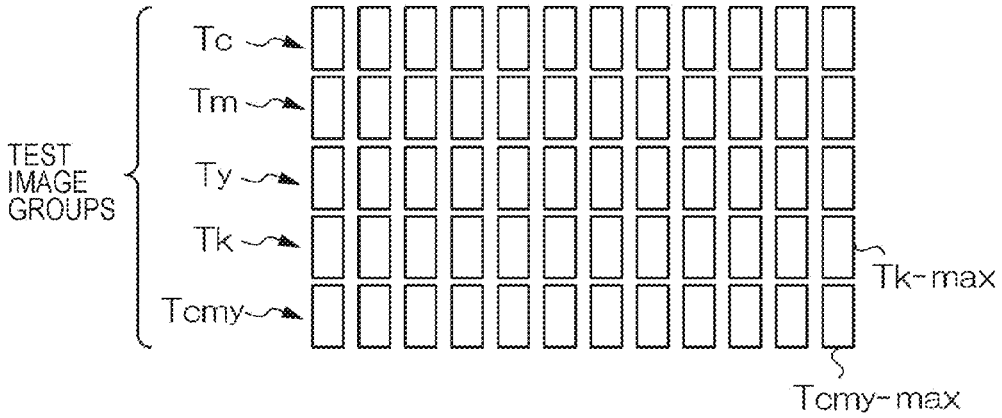
FIG. 5 illustrates an example of test image groups formed on a medium.

FIG. 5 illustrates an example of test image groups formed on a medium. In FIG. 5, a test image group Tc including twelve test images obtained by changing the density of C toner in a scale of twelve levels is shown. Test image groups Tm, Ty, and Tk, each including twelve test images obtained in a manner similar to those of the test image group Tc, are also shown. Each of the test image groups Tc, Tm, Ty, and Tk is formed by using a toner of a single color. On the other hand, test images included in a test image group Tcmy are all formed by using toners of multiple colors (at least two colors) among C, M, and Y. The pixels included in each test image have the same tone value, that is, each test image is a solid image without any difference in the density level.

In this exemplary embodiment, the first measuring unit 101 measures the density of each test image included in the test image groups shown in FIG. 5, and supplies the measured density levels to the adjusting unit 103. In this case, the first measuring unit 101 measures the density, assuming that, among the test images included in the test image groups, the density of a test image formed by using a toner of a first color and fixed on a medium by the fixing unit 29 is the density of a first test image (hereinafter such density will be referred to as a "first density"). In this exemplary embodiment, the first measuring unit 101 measures the density, assuming that K is the first color and that the test image having the maximum tone value (test image Tk-max in FIG. 5) is the first test image and the density of the first test image is the first density. The first measuring unit 101 supplies the measured first density to the determining unit 104.

The second measuring unit 102 measures the density of a toner on the topmost layer of a second test image formed by superposing plural toners of different colors and fixed on a medium by the fixing unit 29. Hereinafter, the density of on the topmost layer of such a second test image will be referred to as a "second density". In this exemplary embodiment, the second measuring unit 102 measures the second density of a toner on the topmost layer of a second test image formed by superposing plural toners of Y, M, and C colors. Among these toners, the Y toner is first transferred to the intermediate transfer belt 25 (first transfer). Accordingly, the Y toner is formed on the topmost layer of the second test image when the image is transferred to the medium (second transfer). Thus, the second measuring unit 102 measures the density of the Y toner formed on the topmost layer of the second test image as the second density.

In this exemplary embodiment, the second measuring unit 102 measures the second density, assuming that a test image including three Y, M, and C toners and having the maximum tone values of Y, M, and C colors (test image Tcmy-max in FIG. 5) is the second test image. The second measuring unit 102 supplies the measured second density to the determining unit 104. The overall density of the second test image is measured by the first measuring unit 101 and is supplied to the adjusting unit 103.

The adjusting unit 103 makes various adjustments which may influence the quality of an image formed by the image forming apparatus 1, on the basis of the density levels of the test images formed on a medium. The adjusting unit 103 makes adjustments so that, for example, the difference between the color represented by image data and the color of an image formed on a medium will be reduced (as close as possible to 0). The adjusting unit 103 makes this color adjustment by generating and updating a lookup table (LCT) in which input tone values and output tone values of each of YMCK colors represented by image data are associated with each other. For making this adjustment, various known techniques may be used. The adjusting unit 103 makes color adjustments on the basis of measurement results supplied from the first measuring unit 101.

In accordance with the transition of each of the above-described first density and second density respectively measured by the first and second measuring units 101 and 102 during the same period, the determining unit 104 determines whether the appropriate value of the second transfer voltage has increased or decreased over time from the second transfer voltage which is currently applied (hereinafter referred to the "current second transfer voltage"). In this case, the period for which the first and second measuring units 101 and 102 make measurements is a period used for determining whether the appropriate value of the second transfer voltage has increased or decreased, and will thus be hereinafter referred to as the "determination period". Strictly speaking, the current second transfer voltage is a value which may be changed from the value which is set at the start of the determination period (hereinafter such a value will be referred to as the "initial value"), for example, due to a temporal change in the physical properties on the surface of the intermediate transfer belt 25. However, in an exemplary embodiment of the invention, it is assumed that such a change is negligible. That is, the initial value of the second transfer voltage is directly used as the current second transfer voltage.

The above-described determination is made by utilizing a change in the efficiency of transferring toner (hereinafter simply referred to as the "transfer efficiency") in accordance with a change in the second transfer voltage (the potential difference between the surface of the intermediate transfer belt 25 and the surface of a medium). The appropriate value of the second transfer voltage is a value which makes it possible to perform second transfer more appropriately than the use of other values of the second transfer voltage. This will be discussed more specifically with reference to FIG. 6.

Figure 6:
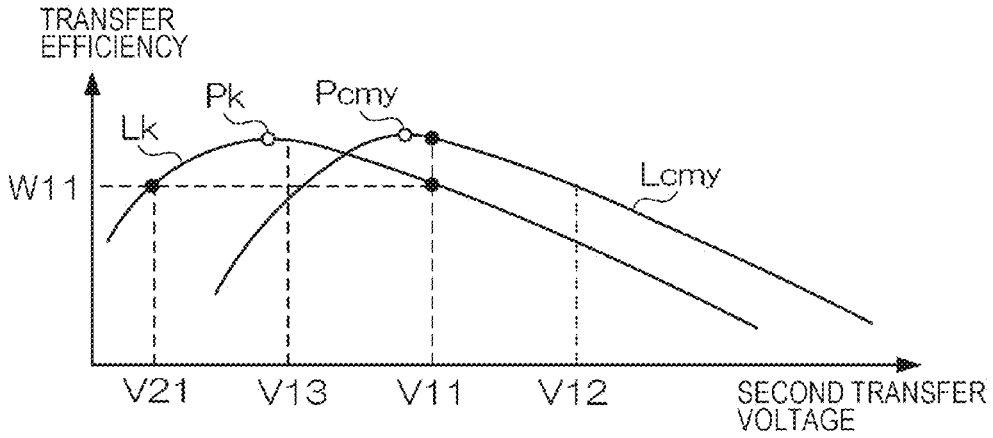
FIG. 6 is a graph illustrating the relationship between a second transfer voltage and the transfer efficiency.

FIG. 6 is a graph illustrating the relationship between the second transfer voltage and the transfer efficiency. In FIG. 6, the horizontal axis indicates the second transfer voltage, and the vertical axis indicates the transfer efficiency. In this graph, a line Lk represents the relationship between the transfer efficiency concerning a first test image and the second transfer voltage, while a line Lcmy represents the relationship between the transfer efficiency concerning a second test image and the second transfer voltage. The line Lk indicates that, as the second transfer voltage changes, the transfer efficiency of toner starts to decrease from a point of a peak Pk. The line Lcmy indicates that, as the second transfer voltage changes, the transfer efficiency of toner starts to decrease from a point of a peak Pcmy. In both cases, the transfer efficiency more gently decreases when the second transfer voltage starts to increase from a point of the peak than when the second transfer voltage starts to decrease from a point of the peak.

It is assumed that, in the image forming apparatus 1, the operator doing the maintenance of the image forming apparatus 1, for example, sets the second transfer voltage V11, which is higher than the second transfer voltage corresponding to the peak Pcmy, as the initial value of the second transfer voltage. The reason for this is as follows. With the application of the second transfer voltage V11 (in comparison with other values of the second transfer voltage), an image formed by using toners of multiple colors, such as a second test image, is transferred to a medium at a relatively high transfer efficiency. Additionally, even if the second transfer voltage is increased or decreased, the transfer efficiency does not change significantly. When the initial value of the second transfer voltage is set, this initial value is the appropriate value of the second transfer voltage. In other words, the appropriate value of the second transfer voltage is a value which makes it possible for toners of multiple colors to be transferred to a medium at relatively high transfer efficiency and which does not change the transfer efficiency significantly even if the second transfer voltage is increased or decreased.

For example, when the second transfer voltage increases from V11 to V12, the transfer efficiency represented by each of the line Lk and the line Lcmy decreases merely gently. When the second transfer voltage decreases from V11 to V13, the transfer efficiency represented by the line Lk increases merely gently, and the transfer efficiency represented by the line Lcmy first increases gently up to the peak Pcmy and then decreases. Accordingly, concerning the line Lcmy, the degree by which the transfer efficiency decreases is smaller than that in a case in which the initial value of the second transfer voltage is set to be the value corresponding to the peak Pcmy. The relationship between the second transfer voltage and the transfer efficiency shown in FIG. 6 is only an example. For example, if the ambient temperature or humidity changes, the line Lk and the line Lcmy shift in the direction of the horizontal axis. Accordingly, the initial value of the second transfer voltage is also changed.

The second transfer voltage corresponding to the peak Pcmy is higher than that corresponding to the peak Pk. The reason for this will be explained below with reference to FIGS. 7A through 8C.

Figure 7A:
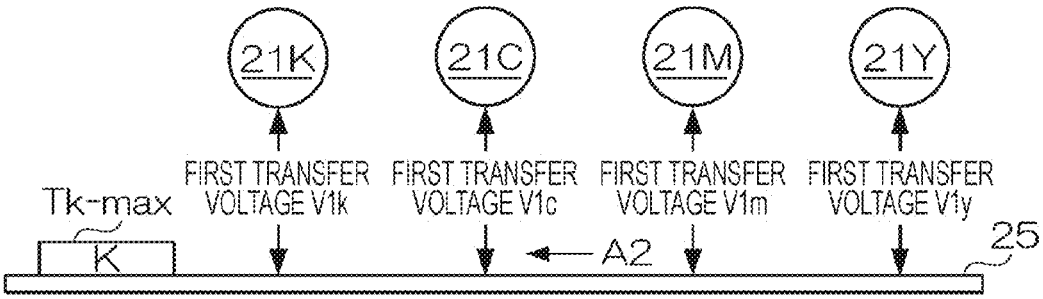
FIGS. 7A and 7B schematically illustrate first transfer voltages to be applied in accordance with individual colors.
Figure 7B:
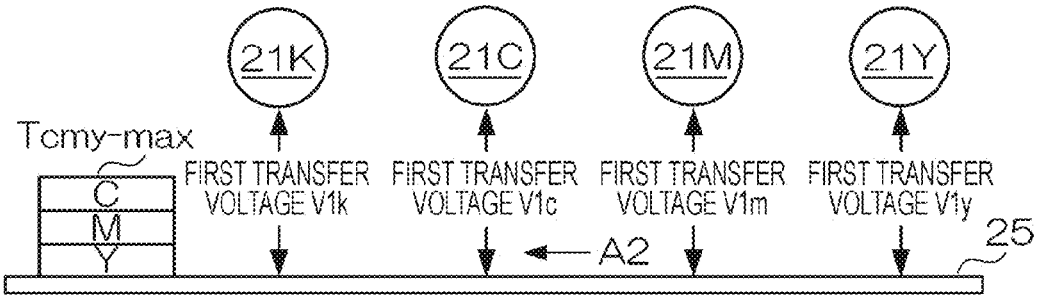

FIGS. 7A and 7B schematically illustrate first transfer voltages to be applied in accordance with Y, M, C, and K colors. A first transfer voltage V1*y* (in this case, the potential difference between the surface of the photoconductor drum 21Y and the surface of the intermediate transfer belt 25) is applied to a portion between the photoconductor drum 21Y and the intermediate transfer belt 25. Similarly, first transfer voltages V1*m*, V1*c*, and V1*k* are respectively applied to portions between the photoconductor drums 21M, 21C, and 21K and the intermediate transfer belt 25. The first transfer voltages V1*y*, V1*m*, V1*c*, and V1*k* are applied even if toner of a corresponding color is not transferred to the intermediate transfer belt 25. Toner transferred to the intermediate transfer belt 25 is transported in the direction indicated by the arrow A2 in FIGS. 7A and 7B.

In FIG. 7A, a test image Tk-max, which is the first test image, is shown. Since the test image Tk-max is obtained as a result of transferring K toner from the photoconductor drum 21K to the intermediate transfer belt 25, only the first transfer voltage V1*k* is applied to K toner in the test image Tk-max. In FIG. 7B, a test image Tcmy-max, which is the second test image, is shown. Among the toners forming the second test image, C toner is transferred from the photoconductor drum 21C to the intermediate transfer belt 25, and thus, the first transfer voltage V1*k*, as well as the first transfer voltage V1*c*, is applied to C toner. Similarly, the first transfer voltages V1*c* and V1*k*, as well as the first transfer voltage V1*m*, are applied to M toner, and the first transfer voltages V1*m*, V1*c*, and V1*k*, as well as the first transfer voltage V1*y*, are applied to Y toner.

Thus, the charge amounts of toners of multiple colors contained in the test image Tcmy-max are greater than the charge amount of K toner contained in the test image Tk-max. Among the toners of multiple colors contained in the test image Tcmy-max, the charge amount is greater in ascending order of C, M, and Y. As the toner has a greater charge amount, the attracting force between the toner and the intermediate transfer belt 25 becomes stronger, and thus, a higher second transfer voltage is required for enhancing the transfer efficiency. In this manner, in the second transfer unit 27 of the image forming apparatus 1, if the second transfer voltage to be applied to an image to be transferred to a medium is changed, the transfer efficiency of toner forming this image starts to decrease from a point of the peak. The peak is determined by the number of times that the first transfer voltage is applied to an image to be transferred to a medium.

Accordingly, as shown in FIG. 6, different peaks (peak Pk and peak Pcmy) of the transfer efficiency are exhibited by toner to which the first transfer voltage is applied only once, such as toner in the test image Tk-max, which is the first test image, and toner to which the first transfer voltage is applied four times, such as Y toner on the topmost layer of the test image Tcmy-max, which is the second test image. The second transfer voltage corresponding to the peak Pcmy to be applied to toner on the topmost layer of the second test image is higher than that of the peak Pk to be applied to toner in the first test image.

Figure 8A:
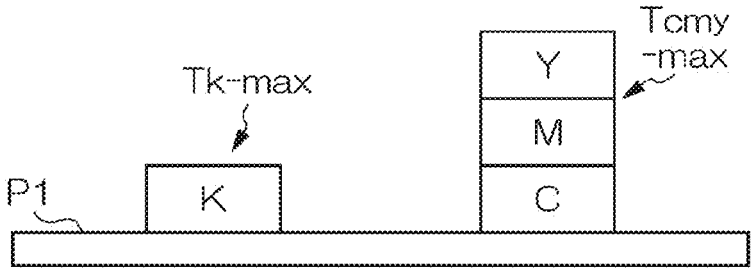
FIGS. 8A through 8C illustrate examples of test images transferred to a medium with the application of different second transfer voltages.
Figure 8B:
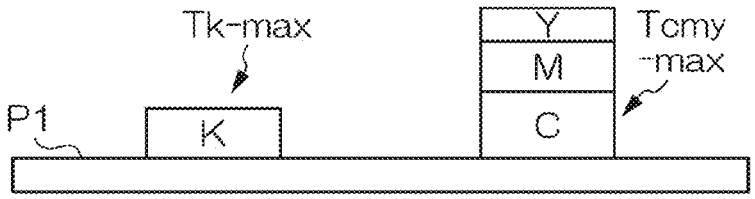
Figure 8C:
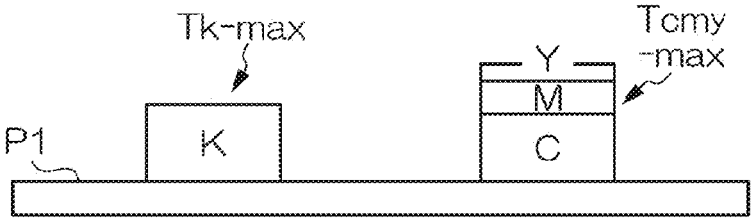

FIGS. 8A through 8C illustrate examples of test images obtained as a result of transferring toners to a medium with the application of different second transfer voltages. FIGS. 8A, 8B, and 8C show test images Tk-max and Tcmy-max obtained as a result of transferring toners to a medium P1 with the application of the second transfer voltages V11, V12, and V13, respectively, shown in FIG. 6. FIG. 8A shows the test images Tk-max and Tcmy-max obtained in the case of the application of the second transfer voltage V11. In this exemplary embodiment, it is assumed that the exposure amount and the developing bias voltage in the image forming apparatus 1 are adjusted so that the amount of toner will be substantially the same among the different colors.

FIG. 8B shows the test images Tk-max and Tcmy-max obtained in the case of the application of the second transfer voltage V12. In this case, as shown in FIG. 6, the transfer efficiency of toner in both of the first and second test images is decreased from that when the second transfer voltage V11 is applied. Accordingly, the amounts of toners in both of the test image Tk-max and the test image Tcmy-max are decreased. Particularly in the test image Tcmy-max, the amount of toner is decreased in ascending order of C, M, and Y. The reason for this may be that the charge amount generated by the first transfer voltage is greater in ascending order of C, M, and Y, as discussed above.

FIG. 8C shows the test images Tk-max and Tcmy-max obtained in the case of the application of the second transfer voltage V13. In this case, as shown in FIG. 6, the transfer efficiency of toner in the first test image is increased and the transfer efficiency of toner in the second test image is decreased from that when the second transfer voltage V11 is applied. Accordingly, the amount of toner in the test image Tk-max is increased, while the amount of toner in the test image Tcmy-max is decreased. The amount of toner in the test image Tcmy-max shown in FIG. 8C is smaller than that in FIG. 8B. As in the test image Tcmy-max shown in FIG. 8B, the amount of toner is decreased in ascending order of C, M, and Y.

As discussed above, the line Lk and the line Lcmy shown in FIG. 6 shift in the direction of the horizontal axis in accordance with a change in the ambient temperature or humidity. Accordingly, even without a change in the second transfer voltage to be applied, if the line Lk and the line Lcmy shift in the direction of the horizontal axis, resulting test images become similar to those obtained with the application of the second transfer voltage V12 or V13 in FIG. 6, and the density of the test image Tk-max and that of the test image Tcmy-max are changed to those shown in FIG. 8B or 8C.

Figure 9A:
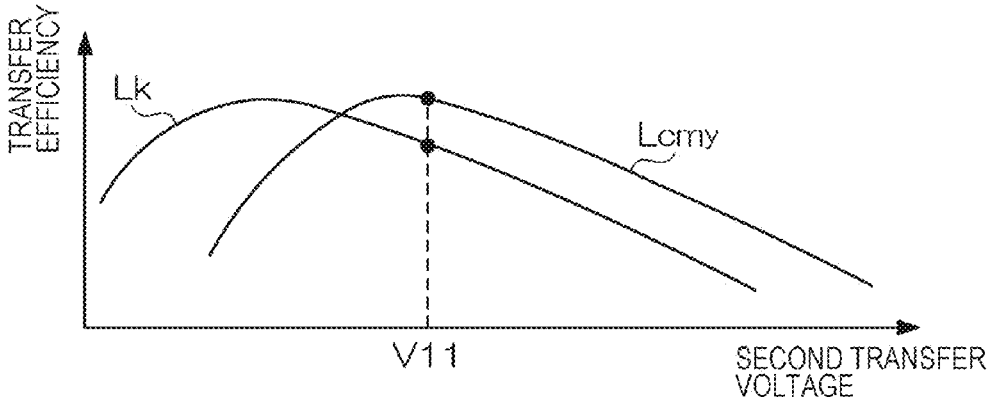
FIGS. 9A through 9C illustrate examples in which lines indicating the relationship between the second transfer voltage and the transfer efficiency are shifted.
Figure 9B:
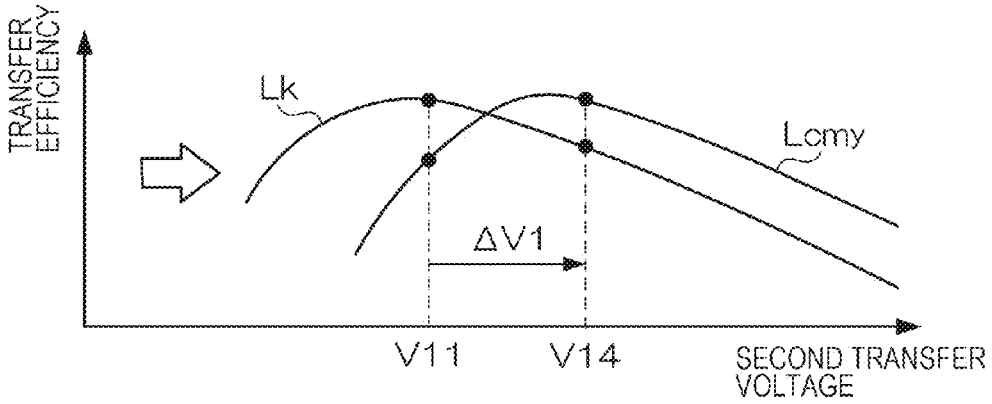
Figure 9C:
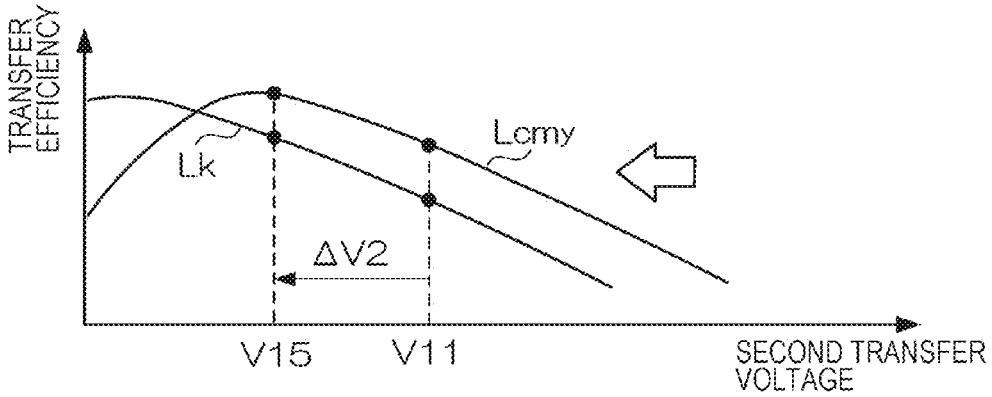

FIGS. 9A through 9C illustrate examples in which a line Lk and a line Lcmy indicating the relationship between the second transfer voltage and the transfer efficiency shift in the direction of the horizontal axis. In the graphs shown in FIGS. 9A through 9C, as well as those in FIG. 6, the horizontal axis indicates the second transfer voltage, and the vertical axis indicates the transfer efficiency. FIG. 9A illustrates a line Lk and a line Lcmy when the second transfer voltage V11 shown in FIG. 6 is applied as the appropriate value. FIG. 9B illustrates a state in which the line Lk and the line Lcmy are shifted to the right side (in the direction in which the second transfer voltage is increased) by an amount ΔV1 due to a change in the ambient temperature or humidity. The amount ΔV1 indicates a difference between the second transfer voltage which implements the transfer efficiency before the line Lk and the line Lcmy are shifted and the second transfer voltage which implements the same level of transfer efficiency after the line Lk and the line Lcmy are shifted.

In the state shown in FIG. 9B, if the second transfer voltage V11 is applied, the transfer efficiency of toners of C, M, and Y is decreased, and thus, the toner amount in the test image Tcmy-max is decreased. In this case, the second transfer voltage V14, which is equal to a value obtained by adding the amount ΔV1 to the second transfer voltage V11, is the appropriate value of the second transfer voltage. FIG. 9C illustrates a state in which the line Lk and the line Lcmy are shifted to the left side (in the direction in which the second transfer voltage is decreased) by an amount ΔV2 (the same amount as ΔV1) due to a change in the ambient temperature or humidity. In the state shown in FIG. 9C, if the second transfer voltage V11 is applied, the transfer efficiency of both of CMY toners and K toner is decreased, and thus, the toner amounts in the test image Tk-max and the test image Tcmy-max are decreased. In this case, the second transfer voltage V15, which is equal to a value obtained by subtracting the amount ΔV2 from the second transfer voltage V11, is the appropriate value of the second transfer voltage.

As described above, if both of the first density (the density of the first test image) and the second density (the density of toner on the topmost layer of the second test image) are decreased, as shown in FIG. 8B, it means that the appropriate value of the second transfer voltage has decreased from the current second transfer voltage, as shown in FIG. 9C. If the first density is increased and the second density is decreased, as shown in FIG. 8C, it means that the appropriate value of the second transfer voltage has increased from the current second transfer voltage, as shown in FIG. 9B. Accordingly, the determining unit 104 determines whether the appropriate value of the second transfer voltage has increased or decreased, depending on whether each of the first density and the second density is increasing or decreasing.

However, if, due to a change in the ambient temperature or humidity, the line Lk and the line Lcmy are shifted further to the right side than the state shown in FIG. 9B, both of the first density and the second density are decreased, such as in the state shown in FIG. 9C in which the line Lk and the line Lcmy are shifted to the left side. In such a case, it is unknown whether the line Lk and the line Lcmy are shifted to the right side or to the left side, that is, whether the appropriate value of the second transfer voltage has increased or decreased. In this exemplary embodiment, therefore, in order to make a determination before the line Lk and the line Lcmy reach such an undefined state, if the second density becomes lower than a predetermined threshold, the determining unit 104 determines whether the appropriate value of the second transfer voltage has increased or decreased, depending on whether each of the first density and the second density is increasing or decreasing.

More specifically, during the period (determination period) until when the second density measured by the second measuring unit 102 becomes lower than a first threshold, if the first density measured by the first measuring unit 101 is increasing, the determining unit 104 determines that the appropriate value of the second transfer voltage has increased from the current second transfer voltage. As discussed above, in this exemplary embodiment, this determination period starts when the second transfer voltage is set to be the initial value. In other words, the determination period starts in a state in which the second transfer unit 27 applies the second transfer voltage (the initial value) higher than the second transfer voltage at which the transfer efficiency of toner on the topmost layer of the second test image reaches the peak, as the appropriate value of the second transfer voltage.

On the other hand, during the period (determination period) until when the second density measured by the second measuring unit 102 becomes lower than a second threshold, if the first density measured by the first measuring unit 101 is decreasing, the determining unit 104 determines that the appropriate value of the second transfer voltage has decreased from the current second transfer voltage. This determination period also starts when the second transfer voltage is set to be the initial value.

An approach to determining the first and second thresholds will be discussed below with reference to FIG. 6. The initial value of the transfer efficiency of toner in the first test image in the case of the application of the second transfer voltage V11, which is the initial value of the second transfer voltage, is set to be W11. In this state, when the second transfer voltage decreases, the transfer efficiency increases up to the peak Pk and then decreases again to W11. The second transfer voltage at which the transfer efficiency of toner in the first test image returns to that (W11) at the start of the determination period is set to be V21. In this case, as the first and second thresholds, a value greater than the second density (the density of the topmost layer of toner in the second test image) measured in the case of the application of the second transfer voltage V21 is used.

For example, if the appropriate value of the second transfer voltage is increasing from the current second transfer voltage since the determination period has started, the transfer efficiency of the first test image increases up to a point of the peak Pk and then starts to decrease from a point of the peak Pk. Accordingly, the measured first density also first increases and then starts to decrease. At this time, if the measured second density is not lower than the first threshold, the second transfer voltage is higher than V21 and the transfer efficiency of the first test image is equal to or higher than W11. Accordingly, the first density (the density of the first test image) measured during the determination period is increasing. Thus, the determining unit 104 correctly determines that the appropriate value of the second transfer voltage has increased from the current second transfer voltage, as described above.

If the second transfer voltage is lower than V21, the first density measured during the determination period is decreasing. Accordingly, if a value equal to or smaller than the second density measured in the case of the application of the second transfer voltage V21 is set to be the second threshold, the measured first density decreases despite that the appropriate value of the second transfer voltage has increased from the current second transfer voltage. In this case, the determining unit 104 may wrongly determine that the appropriate value of the second transfer voltage has decreased from the current second transfer voltage despite that it has actually increased. In other words, if a value greater than the second density measured in the case of the application of the second transfer voltage V21 is set to be the second threshold, the determining unit 104 does not make such a wrong determination.

Examples of determinations made by the determining unit 104 will be discussed below with reference to FIGS. 10A and 10B.

Figure 10A:
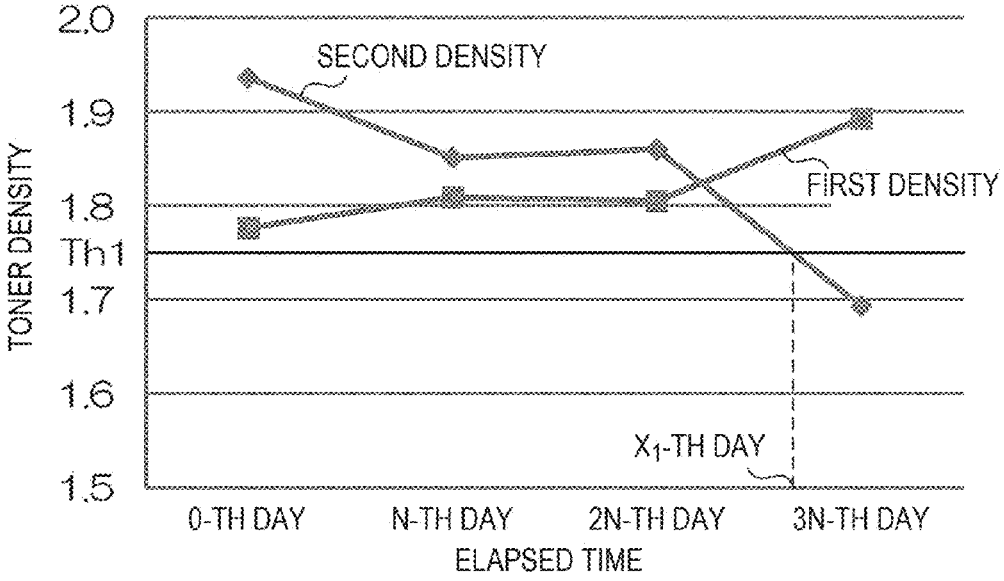
FIGS. 10A and 10B illustrate examples of the transition of a first density and a second density.
Figure 10B:
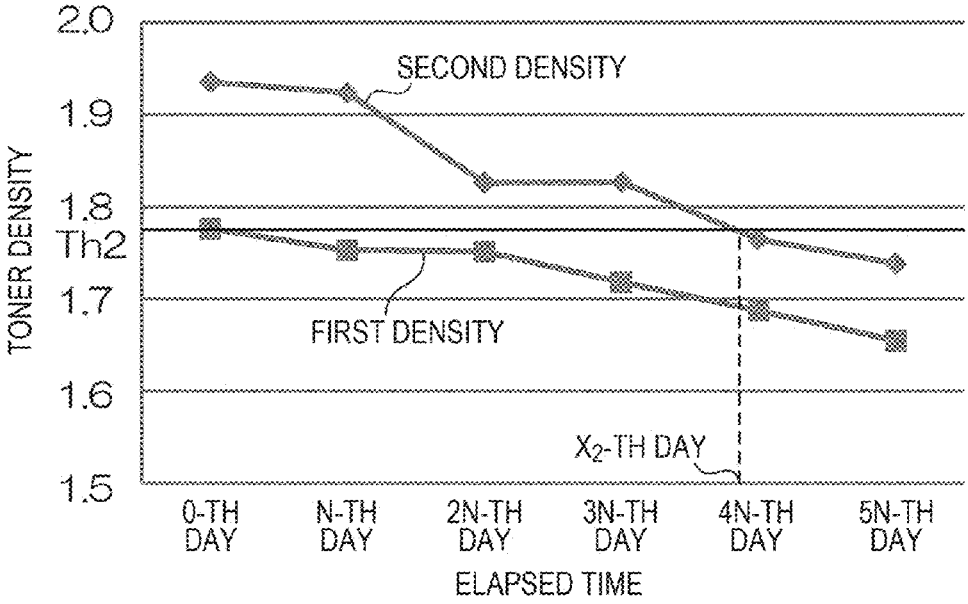

FIGS. 10A and 10B illustrate examples of the transition of the first density and the second density. In the graphs shown in FIGS. 10A and 10B, the horizontal axis indicates the elapsed time, and the vertical axis indicates the toner density. More specifically, FIGS. 10A and 10B each show the transition of the first density measured by the first measuring unit 101 and the second density measured by the second measuring unit 102 every N days (N is a natural number) when the appropriate value of the second transfer voltage is changed from the current second transfer voltage after the second transfer voltage is set to be the initial value V11 on the 0-th day.

In FIG. 10A, the first density is increasing during the period from the 0-th day to the 3N-th day. In contrast, the second density is decreasing during the period from the 0-th day to the 3N-th day. The first threshold Th1 of the toner density is set to be 1.75, and the second density becomes lower than the first threshold Th1 on the $X_1$-th day after the 2N-th day and before the 3N-th day. In this case, when the second density lower than the first threshold Th1 is measured for the first time after the 3N-th day, the determining unit 104 calculates the slope of a regression line of the first density measured during the period (determination period) from the 0-th day to the 3N-th day. Since the calculated slope of the regression line of the first density is a positive value indicating that the first density is increasing, the determining unit 104 determines that the appropriate value of the second transfer voltage has increased from the current second transfer voltage.

In FIG. 10B, the first density is decreasing during the period from the 0-th day to the 5N-th day, and the second density is also decreasing during the period from the 0-th day to the 5N-th day. The second threshold Th2 of the toner density is set to be 1.77, and the second density becomes lower than the second threshold Th2 on the $X_2$-th day after the 3N-th day and before the 4N-th day. In this case, when the second density lower than the second threshold Th2 is measured for the first time after the 4N-th day, the determining unit 104 calculates the slope of a regression line of the first density measured during the period from the 0-th day to the 4N-th day (determination period). Since the calculated slope of the regression line of the first density is a negative value indicating that the first density is decreasing, the determining unit 104 determines that the appropriate value of the second transfer voltage has decreased from the current second transfer voltage.

FIG. 11 illustrates the relationships between the determination results and the slopes of regression lines of the first density and the second density. In FIG. 11, a first slope indicates the slope of a regression line of the first density, while a second slope indicates the slope of a regression line of the second density. The first and second slopes may take one of a value (0 or greater) and a value (smaller than 0). FIG. 11 shows that, if the measured second density is greater than the first threshold and the second threshold (that is, the measured second density is neither lower than the first threshold nor the second threshold), the determination result is "undefined" regardless of any combination of the values of the first slope and the second slope. In this case, "undefined" means that it is unnecessary to make any determination or adjustment or it is unknown that the appropriate value of the second transfer voltage has increased or decreased.

In a case in which the second density is smaller than the first threshold, if the first slope is 0 or greater and the second slope is smaller than 0, it is determined that the appropriate value of the second transfer voltage has increased from the current second transfer voltage. In a case in which the second density is smaller than the second threshold, if both of the first slope and the second slope are smaller than 0, it is determined that the appropriate value of the second transfer voltage has decreased from the current transfer voltage. If the determining unit 104 determines that the appropriate value of the second transfer voltage has increased, it supplies this information to the first voltage control unit 105. If the determining unit 104 determines that the appropriate value of the second transfer voltage has decreased, it supplies this information to the second voltage control unit 106.

Upon receiving information that the appropriate value of the second transfer voltage has increased from the current second transfer voltage from the determining unit 104, the first voltage control unit 105 performs control so that the current second transfer voltage will be increased. More specifically, the first voltage control unit 105 increases the current second transfer voltage by an amount which is determined on the basis of voltage increase control information. The voltage increase control information indicates the relationship between the second transfer voltage and a change in at least one of the first density and the second density which is measured in the case of an increase in the appropriate value of the second transfer voltage.

Figure 12:
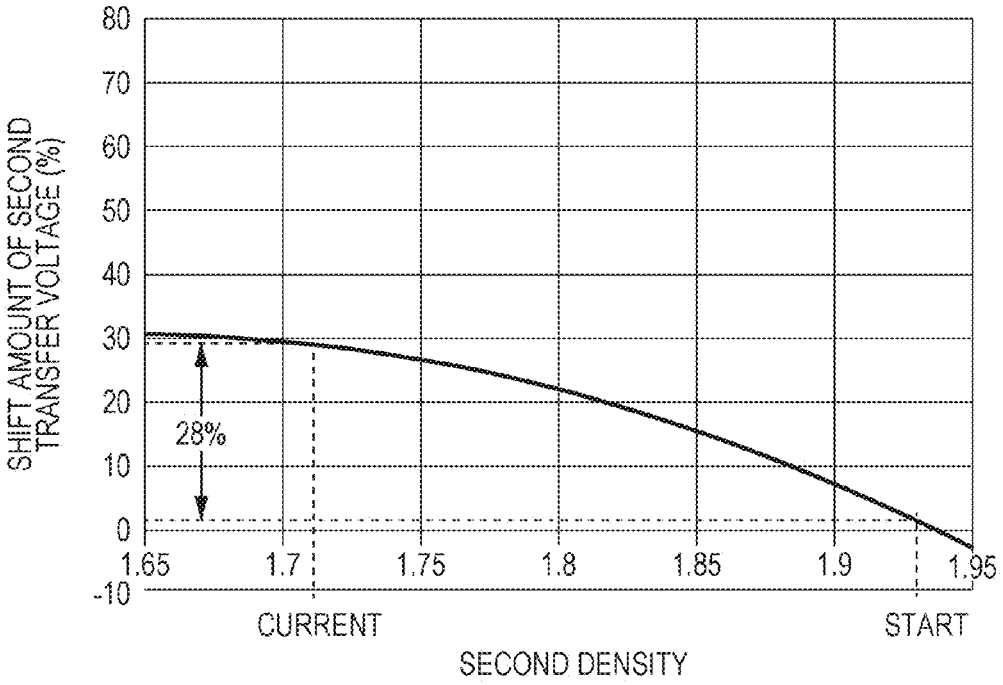
FIG. 12 illustrates an example of voltage increase control information.

FIG. 12 illustrates an example of the voltage increase control information. In the graph shown in FIG. 12, the horizontal axis indicates the second density, and the vertical axis indicates the amount by which the second transfer voltage is shifted (hereinafter referred to as the "shift amount of the second transfer voltage"). In this example, the shift amount of the second transfer voltage at which the second density is measured at the start of the determination period is used as a reference shift amount. As the measured second density decreases, the shift amount of the second transfer voltage increases, and the difference between the shift amount of the second transfer voltage corresponding to the currently measured second density and the reference shift amount is 28%. In this case, the first voltage control unit 105 performs control so that the current second transfer voltage will be increased by 28%.

More specifically, the first voltage control unit 105 increases the bias voltage to be applied to a portion between the second transfer roller 271 and the backup roller 272 by the second transfer unit 27 shown in FIG. 2 so as to increase the second transfer voltage. The first voltage control unit 105 performs this control, for example, by using a table indicating the association between the bias voltage and the second transfer voltage. This table has been created by determining by experiment how the second transfer voltage has changed in accordance with a change in the bias voltage.

Upon receiving information that the appropriate value of the second transfer voltage has decreased from the current second transfer voltage from the determining unit 104, the second voltage control unit 106 performs control so that the current second transfer voltage will be decreased. More specifically, the second voltage control unit 106 decreases the current second transfer voltage by an amount which is determined on the basis of voltage decrease control information. The voltage decrease control information indicates the relationship between the second transfer voltage and a change in at least one of the first density and the second density which is measured in the case of a decrease in the appropriate value of the second transfer voltage.

Figure 13:
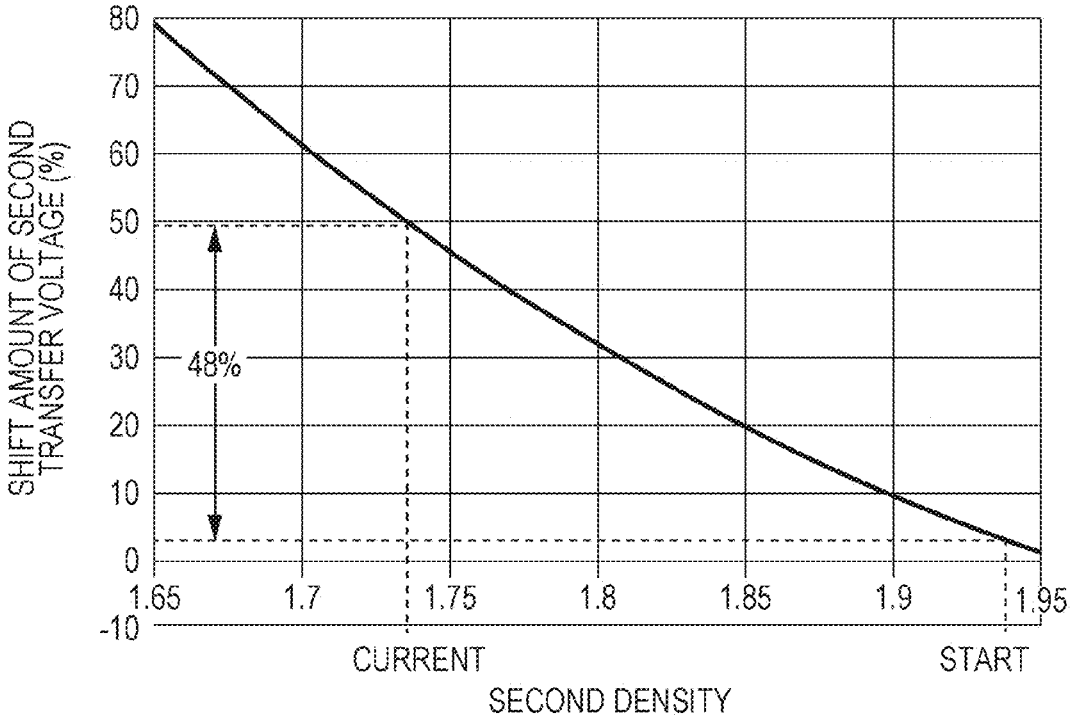
FIG. 13 illustrates an example of voltage decrease control information.

FIG. 13 illustrates an example of the voltage decrease control information. In the graph shown in FIG. 13, as well as in that in FIG. 12, the horizontal axis indicates the second density, and the vertical axis indicates the shift amount of the second transfer voltage. In this example, the difference between the shift amount of the second transfer voltage corresponding to the currently measured second density and the reference shift amount measured at the start of the determination period is 48%. In this case, the second voltage control unit 106 performs control so that the current second transfer voltage will be decreased by 48%. The second voltage control unit 106 performs this control in a manner similar to that performed by the first voltage control unit 105.

Figure 14:
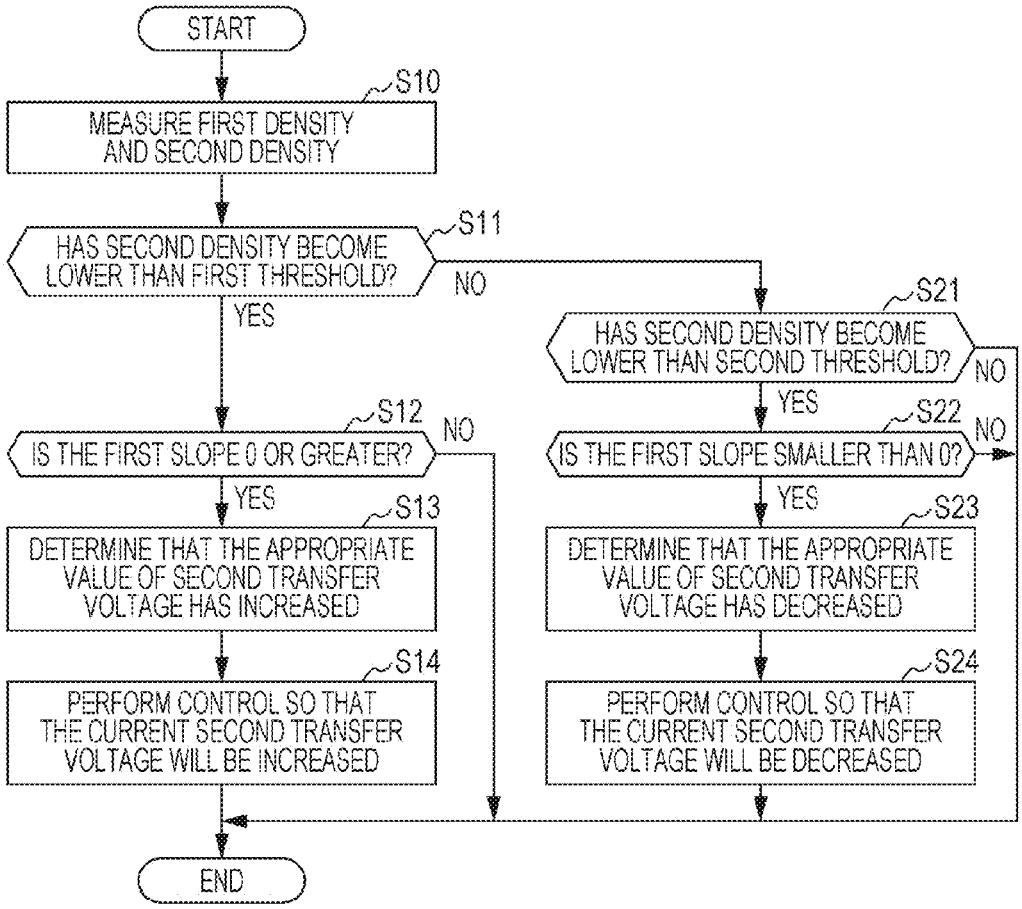
FIG. 14 is a flowchart illustrating an example of an operation procedure executed by the controller.

FIG. 14 is a flowchart illustrating an example of the operation procedure executed by the controller 10. This operation procedure starts upon forming the first test image and the second test image, such as those shown in FIG. 5. First, in step S10, the first and second measuring units 101 and 102 of the controller 10 respectively measure the first density (the density of toner in the first test image) and the second density (the density of toner on the topmost layer of the second test image). Then, in step S11, the determining unit 104 of the controller 10 determines whether or not the second density has become lower than the first threshold. If it is determined that the second density has become lower than the first threshold (the result of step S11 is YES), the determining unit 104 proceeds to step S12 to determine whether or not the slope of a regression line of the measured first density levels (first slope) is 0 or greater.

If it is determined that the first slope is 0 or greater (the result of step S12 is YES), the determining unit proceeds to step S13. In step S13, the determining unit 104 determines that the appropriate value of the second transfer voltage has increased from the current second transfer voltage. Then, in step S14, the first voltage control unit 105 of the controller 10 performs control so that the current second transfer voltage will be increased, and then finishes the operation procedure. If the determining unit 104 determines in step S12 that the first slope is not 0 or greater (the result of step S12 is NO), it terminates the operation procedure.

If the determining unit 104 determines in step S11 that the second density has not become lower than the first threshold (the result of step S11 is NO), the determining unit 104 proceeds to step S21 to determine whether or not the second density has become lower than the second threshold. If it is determined that the second density has become lower than the second threshold (the result of step S21 is YES), the determining unit 104 proceeds to step S22 to determine whether or not the first slope is smaller than 0. If it is determined that the first slope is smaller than 0 (the result of step S22 is YES), the determining unit 104 proceeds to step S23. In step S23, the determining unit 104 determines that the appropriate value of the second transfer voltage has decreased from the current second transfer voltage. Then, in step S24, the second voltage control unit 106 of the controller 10 performs control so that the current second transfer voltage will be decreased and then finishes the operation procedure. If the determining unit 104 determines in step S21 that the second density has not become lower than the second threshold or in step S22 that the first slope is not smaller than 0, it terminates the operation procedure.

As described above, in this exemplary embodiment, a determination is made regarding how the appropriate value of the second transfer voltage has changed (whether it has increased or decreased from the current second transfer voltage) in accordance with a temporal change in the relationship between the second transfer voltage and the transfer efficiency. On the basis of the determination result, the second transfer voltage is controlled (increased or decreased) at an appropriate timing, as discussed above. The first and second test images may also be used for the adjustments to be made by the adjusting unit 103.

[2] Modified Examples

The above-described exemplary embodiment is only an example, and may be modified in the following manner. The exemplary embodiment and the modified examples may be combined according to the necessity.

[2-1] Informing User of Determination Result

In the above-described exemplary embodiment, the second transfer voltage is controlled on the basis of a determination result. However, the determination result may be handled in a different manner.

Figures 15, 16:
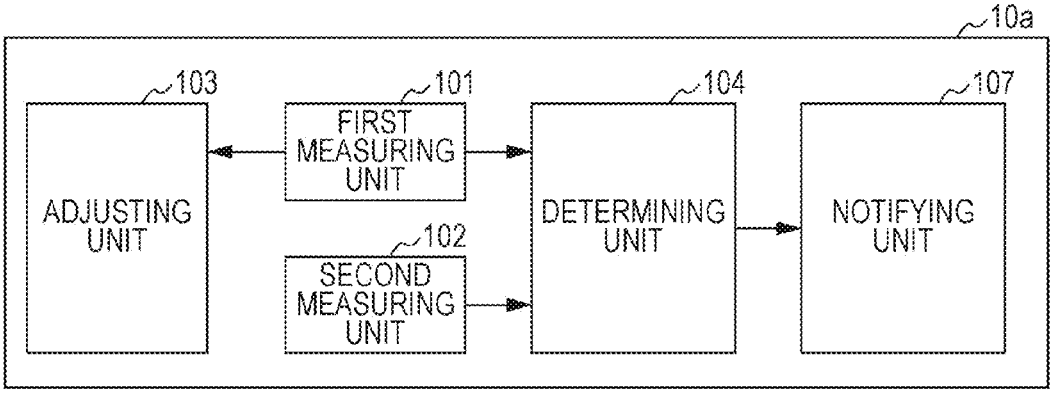
FIG. 15 illustrates the functional configuration of a controller according to a modified example.
FIG. 16 illustrates an example of a determination result sent from a notifying unit.

FIG. 15 illustrates the functional configuration of a controller 10*a* according to a modified example. The controller 10*a* includes a notifying unit 107 instead of the first and second voltage control units 105 and 106 shown in FIG. 4. If the determining unit 104 determines that the second transfer voltage has increased or decreased from the current second transfer voltage, it supplies the determination result to the notifying unit 107.

The notifying unit 107 notifies a user of the determination result supplied from the determining unit 104. In the notifying unit 107, destination information concerning an email address of the user or the IP address of a terminal used by the user in a company, for example, is stored. Upon receiving a determination result from the determining unit 104, the notifying unit 107 sends information indicating the determination result to the destination indicated by the stored destination information.

FIG. 16 illustrates an example of the determination result sent from the notifying unit 107. In this example, the following message is displayed as information indicating the determination result. "A transfer failure may occur since the difference between the current second transfer voltage and its appropriate value is increasing in the image forming apparatus. Please contact the operator and make a request to adjust the second transfer voltage". The user sees this message and recognizes that the appropriate value of the second transfer voltage has increased or decreased. The user may be informed of a determination result in a different manner, for example, a smartphone of the user may be vibrated or sound may be output.

[2-2] First Test Image and Second Test Image

In the above-described exemplary embodiment, the first test image is formed by using K toner. However, the first test image may be formed by using a toner of another color, such as Y, M, or C toner. Likewise, in the exemplary embodiment, the second test image is formed by using three YMC toners. However, the second test image may be formed by using toners of other three colors, such as KYM toners, or may be formed by using toners of two colors. In the exemplary embodiment, test images having the maximum tone values of the corresponding colors are used as the first and second test images. However, test images having a tone value other than the maximum tone value may be used.

Any test image may be used as long as the first peak of the transfer efficiency of toner in the first test image and the second peak of the transfer efficiency of toner on the topmost layer of the second test image, which has been discussed with reference to FIG. 6, are different from each other. If the first peak is smaller than the second peak, determinations may be made in a manner similar to the above-described exemplary embodiment. If the color of the first test image is Y, and the colors of the second test image are K and C, the number of times that the first transfer voltage is applied to Y toner in the first test image is greater than that to K and C toners in the second test image. Accordingly, it may be possible that the first peak become greater than the second peak. In this case, determinations are made in a manner different from the exemplary embodiment.

More specifically, during the period (determination period) until when the first density measured by the first measuring unit 101 becomes lower than a third threshold, if the second density measured by the second measuring unit 102 is increasing, the determining unit 104 determines that the appropriate value of the second transfer voltage has increased from the current second transfer voltage. On the other hand, during the period (determination period) until when the first density measured by the first measuring unit 101 becomes lower than a fourth threshold, if the second density measured by the second measuring unit 102 is decreasing, the determining unit 104 determines that the appropriate value of the second transfer voltage has decreased from the current second transfer voltage. The third and fourth thresholds are determined in a manner similar to the first and second thresholds determined in the exemplary embodiment.

In the exemplary embodiment, the number of times that the first transfer voltage is applied to toner of a single color in the first test image is only once. In contrast, in the modified example, the number of times that the first transfer voltage is applied to toner on the topmost layer of the second test image is twice or more. Accordingly, in the case of the exemplary embodiment, it is easier to increase the difference between the first peak and the second peak than a case in which the first peak is greater than the second peak.

Figure 17A:
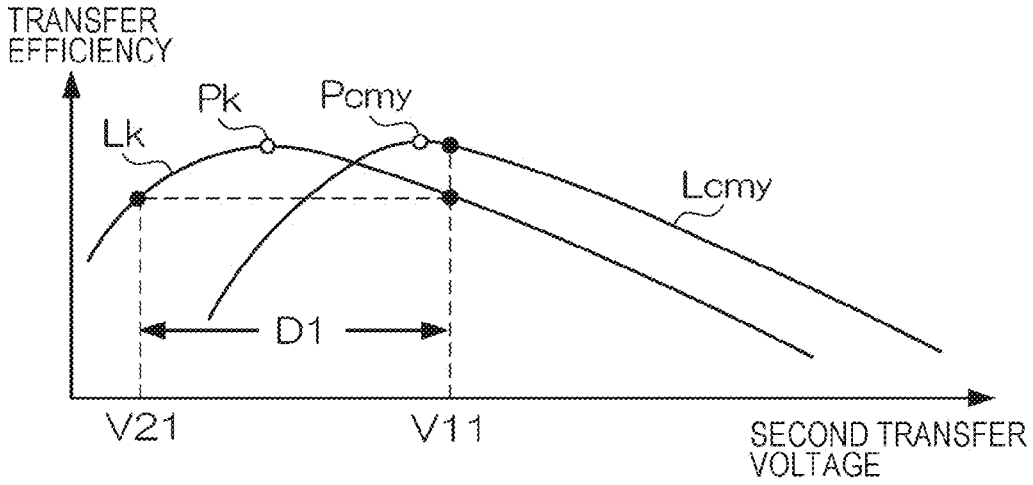
FIGS. 17A and 17B illustrate the relationship between the second transfer voltage and the transfer efficiency for comparison.
Figure 17B:
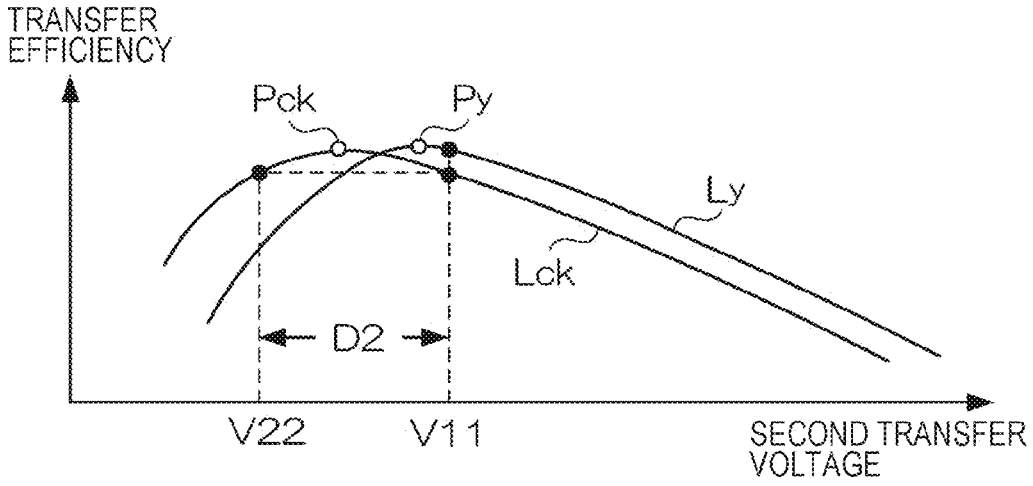

FIGS. 17A and 17B illustrate the relationship between the second transfer voltage and the transfer efficiency for comparison. FIG. 17A illustrates the relationship between the second transfer voltage and the transfer efficiency in the exemplary embodiment. FIG. 17B illustrates the relationship between the second transfer voltage and the transfer efficiency when the first test image is formed by using Y toner and the second image is formed by using K and C toners. In FIG. 17B, Ly represents a change in the transfer efficiency of the first test image, while Lck represents a change in the transfer efficiency of the second test image. In FIG. 17B, Py represents the peak of Ly (first peak), while Pck represents the peak of Lck (second peak).

In the case of FIG. 17A, during the period from V11, which is the initial value of the second transfer voltage, to V21 (the second transfer voltage at which the transfer efficiency of toner in the first test image returns to that at the start of the determination period), the first density is likely to increase, and thus, it is more likely to be determined that the appropriate value of the second transfer voltage has increased. In the case of FIG. 17B, too, the second transfer voltage at which the transfer efficiency of toner in the second test image having a small peak returns to that at the start of the determination period is set to be V22. In the case of FIG. 17B, during the period from V11 to V22, the first density is likely to increase, and thus, it is more likely to be determined that the appropriate value of the second transfer voltage has increased.

Since the difference between the peak Py and the peak Pck in the example shown in FIG. 17B is smaller than that between the peak Pk and the peak Pcmy in the example shown in FIG. 17A, V22 is higher than V21. Accordingly, the difference D2 between V11 and V22 is smaller than the difference D1 between V11 and V21. Thus, as in the exemplary embodiment, in a case in which the number of times that the first transfer voltage is applied to toner on the topmost layer of the second test image is greater than that the first transfer voltage is applied to toner in the first test image, the range in which it is determined that the appropriate value of the second transfer voltage has increased is wider than that in the opposite case.

2-3 Determination Period

In the above-described exemplary embodiment, the determination period used by the determining unit 104 for making a determination is started when the second transfer voltage is set to be the initial value. However, the determination period may start at a different timing. For example, the determining unit 104 may make a determination at predetermined regular times (for example, every day), and the period from a time point dated back for a predetermined time length (for example, 5N days) from a time point at which the determining unit 104 makes a determination to the time point at which the determining unit 104 makes a determination is set to be the determination period. In this case, the length of the determination period is fixed, in contrast to the exemplary embodiment in which the determination period continues to extend until the second density becomes lower than the first or second threshold.

Figure 18:
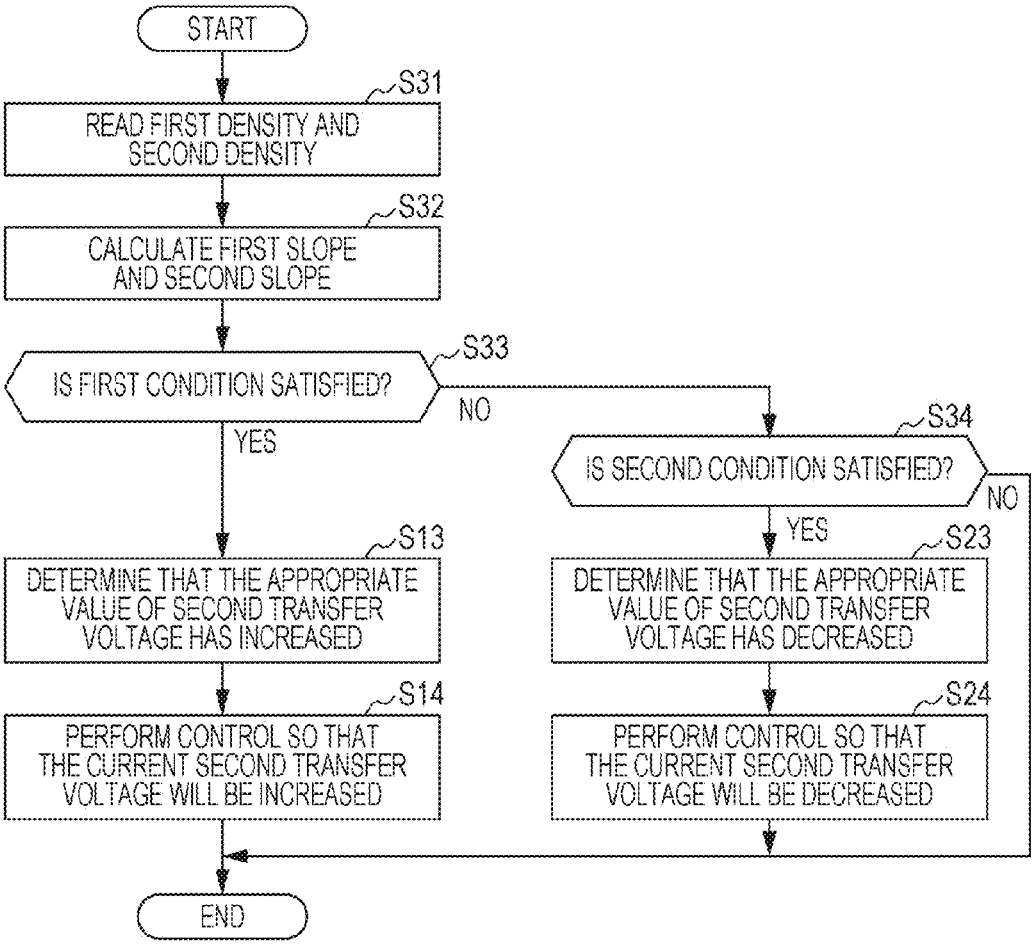
FIG. 18 is a flowchart illustrating an example of an operation procedure executed by a controller of a modified example.

FIG. 18 is a flowchart illustrating an example of the operation procedure executed by the controller 10 of the modified example. First, in step S31, the controller 10 reads the first density and the second density measured during the determination period. Then, in step S32, the controller 10 calculates a first slope of the first density measured during the determination period and a second slope of the second density measured during the determination period. The controller 10 then determines in step S33 whether or not a first condition is satisfied, on the basis of the read second density and the calculated first and second slopes. In this example, the controller 10 determines that the first condition is satisfied if the second density has become lower than the first threshold and if the first slope is 0 or greater. Then, in step S13, the controller 10 determines that the appropriate value of the second transfer voltage has increased, and in step S14, the controller 10 performs control so that the current second transfer voltage will be increased. Then, the controller 10 finishes the operation procedure.

If the controller 10 determines in step S33 that the first condition is not satisfied (the result of step S33 is NO), it proceeds to step S34 to determine whether or not a second condition is satisfied. In this example, the controller 10 determines that the second condition is satisfied if the second density has become lower than the second threshold and if the first slope is smaller than 0. Then, in step S23, the controller 10 determines that the appropriate value of the second transfer voltage has decreased, and in step S24, the controller 10 performs control so that the current second transfer voltage will be decreased. Then, the controller 10 finishes the operation procedure. If the controller 10 determines in step S34 that the second condition is not satisfied (the result of step S34 is NO), it terminates the operation procedure.

2-4 Second Slope

In the exemplary embodiment, the determining unit 104 makes a determination on the basis of the second density and the first slope. However, the determining unit 104 may make a determination on the basis of the second slope as well as the first slope. A first condition and a second condition to be used in such a case when the operation shown in FIG. 18 is executed are shown in FIGS. 19A and 19B, respectively.

FIGS. 19A and 19B respectively illustrate the first condition and the second condition used in this modified example. The first condition is satisfied if the second density is lower than the first threshold and if the first slope is 0 or greater and the second slope is smaller than 0. The second condition is satisfied if the second density is lower than the second threshold and if the first slope is smaller than 0 and the second slope is smaller than 0. When the second density becomes lower than the first or second threshold, it is most probably that the second density is decreasing. Accordingly, if the second density is lower than the first or second threshold, it is highly likely that the second slope is 0 or smaller.

However, after the second density is increasing for a while, if an abnormality occurs in the formation of the second test image or in the measurements by the second measuring unit 102, the second density suddenly drops to a value lower than the first threshold or the second threshold. In this case, however, it is possible that the second slope become 0 or greater. If the second density is increasing, it is most probably that the first density is also increasing. In this case, the determining unit 14 may wrongly determine that the appropriate value of the second transfer voltage has increased. In the modified example, however, such a wrong determination is avoided.

2-5 Approach to Calculating Slopes

The determining unit 104 may calculate the first and second slopes in a manner different from the exemplary embodiment. For example, the determining unit 104 may calculate the first slope on the basis of the first density measured for the first time in the determination period and the first density measured for the last time in the determination period. The determining unit 104 may also calculate the second slope on the basis of the second density measured for the first time in the determination period and the second density measured for the last time in the determination period. In this approach, regardless of in which manner the second density increases or decreases during the determination period, if the second density becomes lower than the first or second threshold, it is certain that the second slope becomes 0 or smaller. As a result, when the second density actually drops suddenly, not because of the occurrence of an abnormality in the formation of the second test image or in the measurements by the second measuring unit 102, it is determined that the appropriate value of the second transfer voltage has decreased.

2-6 Position at which Density is Measured

In the exemplary embodiment, the sensor 30 is disposed on the downstream side of the fixing unit 29 in the transport direction A3, and measures the physical quantity indicating the density of toner in test images fixed on a medium by the fixing unit 29. However, the sensor 30 may be located at a different position. For example, the sensor 30 may be disposed on the downstream side of the second transfer unit 27 and on the upstream side of the fixing unit 29 in the transport direction A3, and may measure the physical quantity indicating the density of toner in test images which has been transferred to a medium but has not been fixed on the medium. No matter whichever case it is, that is, whether or not toner in test images has been fixed on a medium, the density of toner in the test images transferred to a medium is measured. However, as in the exemplary embodiment, if measurements are carried out after toner is fixed on a medium, the density of images close to those output from the image forming apparatus 10 and actually seen by a user is measured. Therefore, the precision in the appropriate value of the second transfer voltage is enhanced.

2-7 Categories of the Invention

The invention may be implemented as an information processing device, such as a controller, or an image forming apparatus including such an information processing device. The invention may also be implemented as a processing method for performing processing executed by a computer which controls the image forming apparatus or as a program for causing the computer to function as, for example, the elements shown in FIG. 4. This program may be provided in the form of a recording medium, such as an optical disc, storing the program therein, or may be provided as a result of the computer downloading and installing the program therein via a communication line, such as the Internet.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

at least one hardware processor configured to implement:

two or more photoconductors configured to each hold an image formed by using a toner;

an image carrier configured to hold images transferred from the two or more photoconductors;

a first transfer unit configured to transfer images from the two or more photoconductors to the image carrier by applying a first transfer voltage to the two or more photoconductors and the image carrier;

a second transfer unit configured to transfer an image from the image carrier to a medium by applying a second transfer voltage to the image carrier and the medium, and in which if the second transfer voltage changes, the efficiency of transferring a toner which forms an image to be transferred from the image carrier to the medium starts to decrease from a point of a peak, the peak being determined by the number of times that the first transfer voltage is applied to the image;

a first measuring unit configured to measure density of a first test image which has been formed by using a toner of a first color and which has been transferred from the image carrier to the medium;

a second measuring unit configured to measure density of a toner on a topmost layer of a second test image which has been formed by superposing a plurality of toners of different colors and which has been transferred from the image carrier to the medium; and a determining unit configured to determine whether an appropriate value of the second transfer voltage has increased or decreased over time from the second transfer voltage which is currently applied, in accordance with a comparison between a change in the density measured by the first measuring unit during a certain period and a change in the density measured by the second measuring unit during the certain period, wherein the determining unit is further configured to determine, if the density measured by the first measuring unit is decreasing during the certain period and if the density measured by the second measuring unit becomes lower than a second threshold during the certain period, that the appropriate value of the second transfer voltage has decreased from the second transfer voltage which is currently applied.

2. The image forming apparatus according to claim 1, wherein the number of times that the first transfer voltage is applied to the toner on the topmost layer of the second test image is greater than the number of times that the first transfer voltage is applied to the toner of the first test image.

3. The image forming apparatus according to claim 1, wherein the determining unit is further configured to determine, if the density measured by the first measuring unit is increasing during a period until the density measured by the second measuring unit becomes lower than a first threshold, that the appropriate value of the second transfer voltage has increased from the second transfer voltage which is currently applied.

4. The image forming apparatus according to claim 1, wherein the at least one hardware processor is further configured to implement:

a first voltage control unit configured to perform control, if the determining unit determines that the appropriate value of the second transfer voltage has increased from the second transfer voltage which is currently applied, so that the second transfer voltage which is currently applied will be increased by an amount determined on the basis of information, the information indicating a relationship between the second transfer voltage and a change in at least one of the density of the first test image and the density of the toner on the topmost layer of the second test image which are measured in the case of an increase in the appropriate value of the second transfer voltage from the second transfer voltage which is currently applied.

5. The image forming apparatus according to claim 1, wherein the at least one hardware processor is further configured to implement:

a second voltage control unit configured to perform control, if the determining unit determines that the appropriate value of the second transfer voltage has decreased from the second transfer voltage which is currently applied, so that the second transfer voltage which is currently applied will be decreased by an amount determined on the basis of information, the information indicating a relationship between the second transfer voltage and a change in at least one of the density of the first test image and the density of the toner on the topmost layer of the second test image which are measured in the case of a decrease in the appropriate value of the second transfer voltage from the second transfer voltage which is currently applied.

6. The image forming apparatus according to claim 1, wherein the at least one hardware processor is further configured to implement:

a notifying unit configured to notify a user of a determination result obtained from the determining unit.

7. The image forming apparatus according to claim 1, wherein the at least one hardware processor is further configured to implement:

an adjusting unit configured to make an adjustment on the basis of a density of a test image formed on the medium, wherein the first and second test images are used for an adjustment made by the adjusting unit.

8. The image forming apparatus according to claim 1, wherein the determining unit is further configured to determine the change in the density measured by the first measuring unit as a first slope of a regression line comprising values of densities of a plurality of first test images, including the first test image, which have been formed by using the toner of the first color, and the determining unit is further configured to determine the change in the density measured by the second measuring unit as a second slope of a regression line comprising values of densities of a plurality of second test images, including the second test image, which have been formed by using the plurality of toners of the different colors.

9. The image forming apparatus according to claim 8, wherein the determining unit is further configured to determine that the appropriate value has increased in response to determining that the first slope is greater than or equal to zero and the second slope is less than zero.

10. The image forming apparatus according to claim 8, wherein the determining unit is further configured to determine that the appropriate value has decreased in response to determining that the first slope and the second slop are less than zero.

11. An image forming method comprising:

transferring images from two or more photoconductors to an image carrier by applying a first transfer voltage to the two or more photoconductors and the image carrier;

transferring an image from the image carrier to a medium by applying a second transfer voltage to the image carrier and the medium, wherein if the second transfer voltage changes, the efficiency of transferring a toner which forms an image to be transferred from the image carrier to the medium starts to decrease from a point of a peak, the peak being determined by the number of times that the first transfer voltage is applied to the image;

measuring density of a first test image which has been formed by using a toner of a first color and which has been transferred from the image carrier to the medium;

measuring density of a toner on a topmost layer of a second test image which has been formed by superposing a plurality of toners of different colors and which has been transferred from the image carrier to the medium;

determining whether an appropriate value of the second transfer voltage has increased or decreased over time from the second transfer voltage which is currently applied, in accordance with a comparison between a change in the density of the first test image during a certain period and a change in the density of the toner on the topmost layer of the second test image during the certain period; and determining, if the density of the first test image is decreasing during the certain period and if the density of the toner on the topmost layer of the second test image becomes lower than a second threshold during the certain period, that the appropriate value of the second transfer voltage has decreased from the second transfer voltage which is currently applied.

12. A non-transitory computer readable medium storing a program causing a computer in an image forming apparatus to execute a process, the image forming apparatus including two or more photoconductors configured to each hold an image formed by using a toner, an image carrier configured to hold images transferred from the two or more photoconductors, a first transfer unit configured to transfer images from the two or more photoconductors to the image carrier by applying a first transfer voltage to the two or more photoconductors and the image carrier, a second transfer unit configured to transfer an image from the image carrier to a medium by applying a second transfer voltage to the image carrier and the medium, and in which if the second transfer voltage changes, the efficiency of transferring a toner which forms an image to be transferred from the image carrier to the medium starts to decrease from a point of a peak, the peak being determined by the number of times that the first transfer voltage is applied to the image, the process comprising:

measuring density of a first test image which has been formed by using a toner of a first color and which has been transferred from the image carrier to the medium;

measuring density of a toner on a topmost layer of a second test image which has been formed by superposing a plurality of toners of different colors and which has been transferred from the image carrier to the medium;

determining whether an appropriate value of the second transfer voltage has increased or decreased over time from the second transfer voltage which is currently applied, in accordance with a comparison between a change in the density of the first test image during a certain period and a change in the density of the toner on the topmost layer of the second test image during the certain period; and determining, if the density of the first test image is decreasing during the certain period and if the density of the toner on the topmost layer of the second test image becomes lower than a second threshold during the certain period, that the appropriate value of the second transfer voltage has decreased from the second transfer voltage which is currently applied.

* * * * *